US009493297B2

(12) United States Patent
Bartoli et al.

(10) Patent No.: US 9,493,297 B2
(45) Date of Patent: Nov. 15, 2016

(54) CAPSULE FOR BEVERAGES

(71) Applicant: SARONG SOCIETA' PER AZIONI, Reggiolo (Reggio Emilia) (IT)

(72) Inventors: Andrea Bartoli, Reggio Emilia (IT); Davide Capitini, Reggio Emilia (IT); Alessandro Grillenzoni, Campogalliano (IT)

(73) Assignee: SARONG SOCIETA' PER AZIONI, Reggiolo (Reggio (IT)

( * ) Notice: Subject to any disclaimer, the term of this patent is extended or adjusted under 35 U.S.C. 154(b) by 0 days.

(21) Appl. No.: 14/655,096

(22) PCT Filed: Dec. 23, 2013

(86) PCT No.: PCT/IB2013/061266

§ 371 (c)(1),
(2) Date: Jun. 24, 2015

(87) PCT Pub. No.: WO2014/102701

PCT Pub. Date: Jul. 3, 2014

(65) Prior Publication Data

US 2015/0344219 A1 Dec. 3, 2015

(30) Foreign Application Priority Data

Dec. 27, 2012 (IT) ..... MO2012A0326
Oct. 17, 2013 (IT) ..... MO2013A0296
Nov. 20, 2013 (IT) ..... MO2013A0320

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

2007/0196402 A1 8/2007 De La Mettrie et al.
2011/0045144 A1 2/2011 Boussemart et al.
2011/0110180 A1* 5/2011 Snider ..... A47J 31/407 366/142
2011/0244108 A1 10/2011 Rabin
2012/0070551 A1 3/2012 Mahlich
2013/0105340 A1 5/2013 Hother et al.

FOREIGN PATENT DOCUMENTS

DE 102010030988 A1 1/2012
EP 2412645 A1 2/2012

(Continued)

OTHER PUBLICATIONS

International Preliminary Report on Patentability Application No. PCT/IB2013/061266 Mailing Date: Dec. 8, 2014 22 pages.

(Continued)

*Primary Examiner* — Erik Kashnikow
*Assistant Examiner* — Chaim Smith
(74) *Attorney, Agent, or Firm* — Whitmyer IP Group LLC

(57) ABSTRACT

A capsule, including: a deformable casing defining a cavity containing an initial product joined to a fluid for making a final product; a nozzle associated with the casing to inject the fluid of a brewing machine, the nozzle having a longitudinal side wall being provided with at least one outflow opening to the cavity, and the nozzle having an end wall provided with a second opening enabling the final product to exit from the cavity.

28 Claims, 8 Drawing Sheets

(56) References Cited

FOREIGN PATENT DOCUMENTS

| | | | |
|---|---|---|---|
| WO | 2007114685 | A1 | 10/2007 |
| WO | 2010137960 | A1 | 12/2010 |
| WO | 2012104760 | A1 | 8/2012 |
| WO | 2013105036 | A1 | 7/2013 |
| WO | 2013132450 | A1 | 9/2013 |
| WO | 2013156932 | A1 | 10/2013 |

OTHER PUBLICATIONS

International Search Report and Written Opinion of the International Searching Authority Application No. PCT/IB2013/061266 Completed: Mar. 25, 2014; Mailing Date: Apr. 7, 2014 10 pages.
Italian Search Report Application No. IT MO20130296 Issued: Jul. 1, 2014 7 pages.
Italian Search Report Application No. IT MO20130320 Completed: Aug. 7, 2015 7 pages.

* cited by examiner

Fig. 5
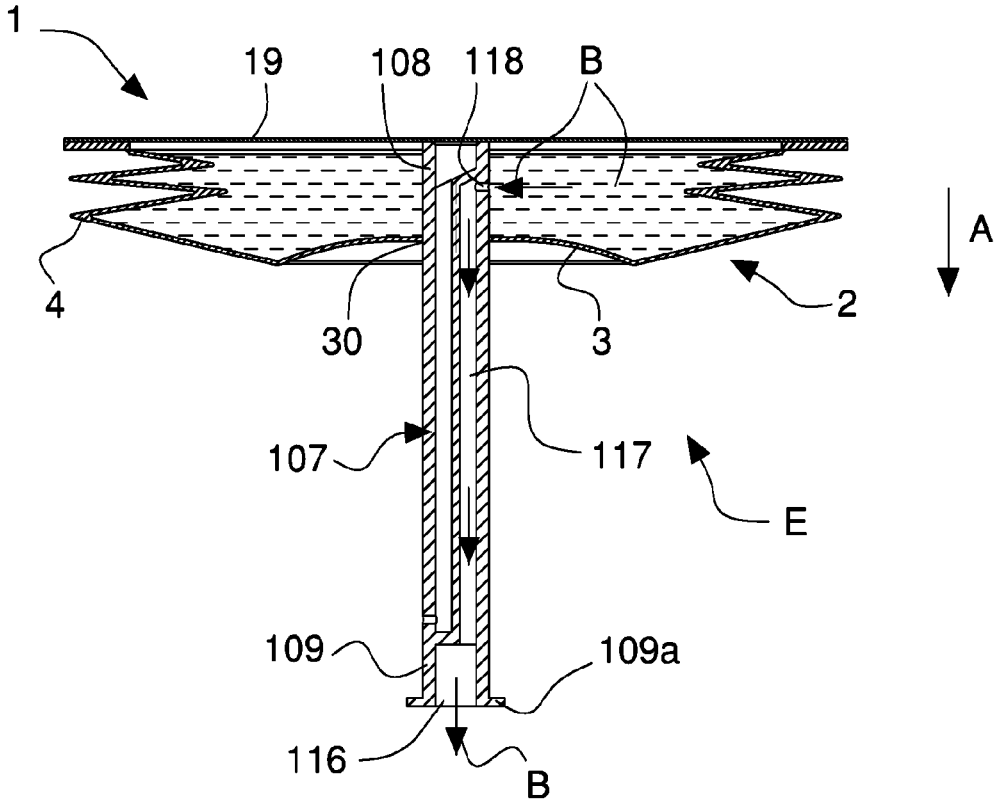
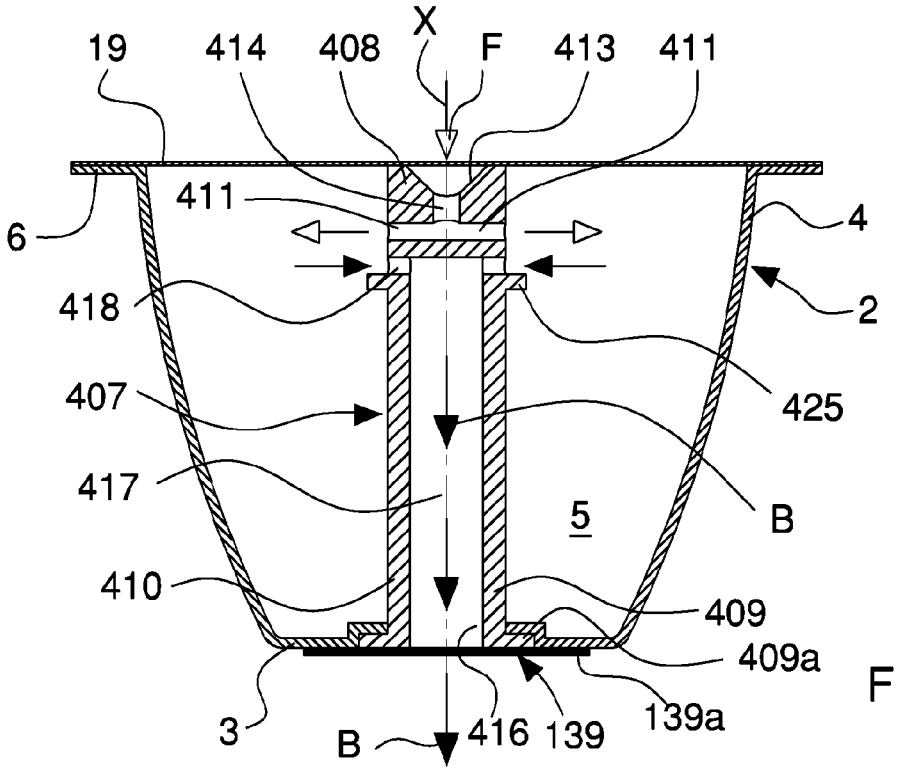
Fig. 8

CAPSULE FOR BEVERAGES

CROSS-REFERENCE TO RELATED APPLICATIONS

This application is a national phase of PCT International Application No. PCT/IB2013/061266 filed Dec. 23, 2013. PCT/IB2013/061266 claims priority to IT Applications No. MO2012A000326 filed Dec. 27, 2012, No. MO2013A000296 filed Oct. 17, 2013, and No. MO2013A000320 filed Nov. 20, 2013. The entire contents of these applications are incorporated herein by reference.

FIELD OF THE INVENTION

The invention relates to capsules or containers for preparing beverages in automatic brewing machines, in particular, it relates to a sealed single-dose and disposable capsule containing a percolable or soluble, or freeze-dried, or dehydrated, or concentrated initial product capable of making a final product, for example, a beverage, by interacting with a pressurized fluid, typically water or milk.

The invention also relates to methods for using the capsule in an automatic brewing machine.

BACKGROUND OF THE INVENTION

The known capsules for use in known brewing machines are disposable and single-dose containers comprising an external casing, made of liquid- and gas-impermeable plastics and having the shape of a glass or a cup. In particular, the casing has a bottom wall and a side wall defining a cavity provided with an upper opening through which the product can be inserted from which the beverage can be obtained. The upper opening is hermetically sealed by a cover, typically an aluminum or plastic film sheet, so as to seal the product inside the container cavity. The capsule is perforable to allow the inflow of pressurized liquid, typically water, and the exit of the obtained beverage. In particular, the cover and the bottom wall of the casing are perforable by suitable means of the brewing machine, to allow the delivering from the top of the pressurized liquid and the extraction from the bottom of the beverage, respectively.

A drawback of the known capsules disclosed above is that they can be used only in brewing machines provided with a special delivering circuit comprising an extracting arrangement suitable to perforate the capsule bottom to allow the outflow of the beverage, and a duct arrangement suitable to convey the beverage to the fruition container (for example, a mug, a cup, a glass, etc.). Such a delivering circuit makes the machine structure more complex and expensive. Furthermore, since such delivering circuit is in contact with the delivered beverages, it should be suitably washed after each delivering operation, both for hygienic reasons, and not to compromise the taste and quality (organoleptic qualities) of a beverage that is subsequently delivered (for example, an aromatic infusion delivered after a coffee). However, a washing arrangement of the delivering circuit is not always present in the known machines, due to their manufacturing complexity and costs.

The known brewing machines further comprise a supply circuit provided with an injecting arrangement (typically, needles or sharpened nozzles) providing to perforate the cover and deliver the pressurized liquid coming from a pump and/or a boiler.

During the production operative step of the beverage, the injecting arrangement can contact the product and/or the beverage, thus getting contaminated. As the delivering circuit, the injecting arrangement of the supply circuit should be suitably washed after each delivering operation, due to hygienic reasons, and to not compromise the organoleptic properties of a beverage delivered at a later moment.

The known capsules disclosed above allow to obtain a final product by percolation of the liquid through the initial product (typically, coffee) or by solubilization or dissolution of the initial product (for example, tea, infusions, etc.).

In the case of soluble products, due to the generally reduced volume of the capsule, it is sometimes necessary to dilute the final product by adding further liquid and continuously mixing the mixture. However, such operation cannot be carried out in an automatic manner using the known capsules and brewing machines, but it has to be carried out manually by the user.

In the case of products to be percolated, typically coffee or barley, it is necessary to ensure a suitable compression and compaction of the initial product (powdery, with a variable particle size) inside the capsule to prevent the formation of preferred passage pathways of the fluid during the percolation. Such preferred passage pathways determine, as it is known, a partial, incomplete diffusion of the fluid F through the mass of initial product P with the result of a final beverage B (coffee) with a poor quality and with unsatisfactory organoleptic characteristics.

SUMMARY OF THE INVENTION

In order to solve such drawback, the known capsules require a particularly accurate filling process to ensure a suitable compression and compaction of the powders. Furthermore, the casing of the capsule has to be suitably strong to resist to the filling and compaction process without deformation, thus compromising the aesthetical appearance. For this reason, such capsules are generally made of aluminum or plastics having a high thickness and turn out to be more expensive than the standard capsules.

An object of the present invention is to improve the known capsules for beverages or fluid food products, in particular sealed, disposable and single-dose capsules containing a percolable, soluble, freeze-dried, dehydrated, concentrated product suitable to interact with a fluid, typically hot pressurized water, to prepare a corresponding final product in an automatic brewing machine.

Another object is to manufacture a hermetic and sealed capsule, of the perforable type and capable of delivering a final product directly into a fruition container (cup, glass, etc.) without the need to be perforated by means of the brewing machine.

A further object is to obtain a capsule allowing not to contaminate or pollute with the initial product and/or with the final product means or parts of the brewing machine, thereby ensuring both the hygiene and the cleanliness of the latter, and the taste and quality, i.e., the integrity of the organoleptic properties, of the final product.

Still another object is to manufacture a capsule allowing solubilizing and/or mixing in an optimal manner the initial product with the fluid and, furthermore, diluting as desired the final product inside the fruition container.

Still a further object is to make a capsule allowing percolating in an optimal and complete manner an initial product with the fluid so as to make a final product having a high quality.

A further different object is to make a capsule capable of delivering a final product directly into a fruition container (cup, glass, etc.) allowing a user separating in a simple manner components in recyclable plastics of which the capsule is made, from non-recyclable components such as, for example, multilayered polylaminates containing aluminum.

A still different object is to make an extremely versatile capsule, capable of meeting the tastes of multiple different consumers, while keeping the initial product contained therein unaltered.

These objects and still others are achieved by a capsule according to one or more of the claims set out below.

BRIEF DESCRIPTION OF THE DRAWINGS

The invention can be better understood and implemented with reference to the attached drawings, that illustrate some embodiments thereof by way of non-limiting example, in which:

FIG. 5 is a cross-section of the capsule in FIG. 1 in a delivering step of a final product;

FIGS. 6 to 10 are partial cross-sections of respective versions of the capsule of the invention;

DETAILED DESCRIPTION OF THE INVENTION

Herein below, the same elements will be indicated by the same numerals in the various Figures.

Figure 11:
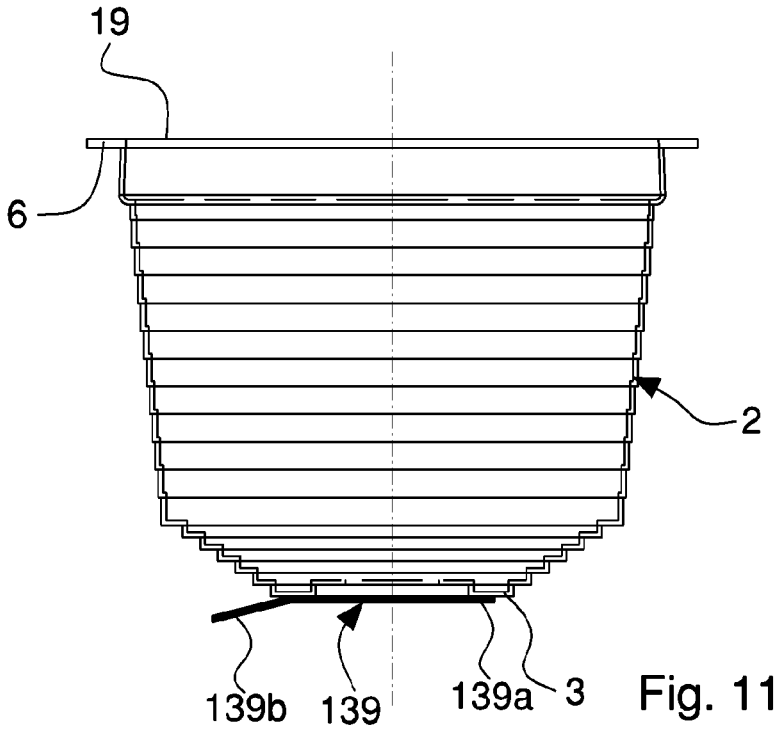
FIG. 11 is a side view of the capsule of the invention, comprising a closing element provided with a tab.
Figure 12:
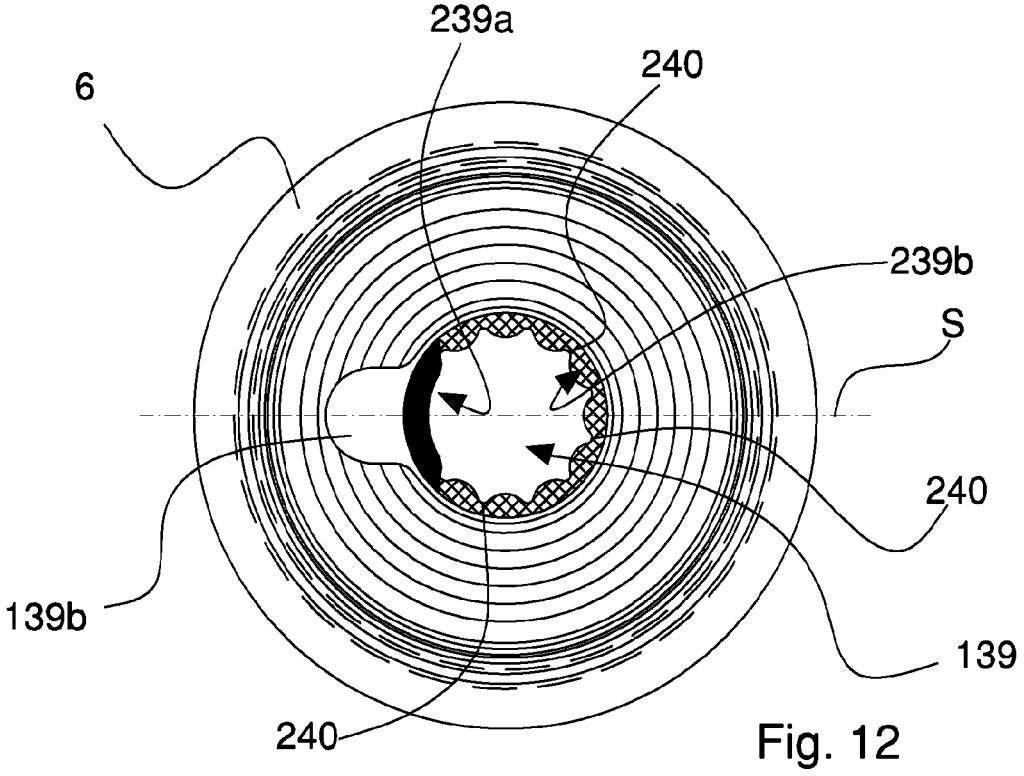
FIG. 12 is a bottom view of the capsule in FIG. 11.

With reference to the FIGS. 1 to 5 and to the FIGS. 11 and 12, a capsule 1 according to the invention is illustrated, containing an initial product P and usable in an automatic brewing machine to produce, by injection of a pressurized fluid therein, a final product B, for example, a beverage, such as coffee, barley, tea, etc.

The initial product P is, for example, a soluble, freeze-dried, dehydrated, concentrated, percolable, for infusion, food product.

The capsule 1 comprises an external casing 2, or container, substantially in the shape of a glass or a cup, provided with a base wall 3 and with a side wall 4, defining a cavity 5 which is open and suitable to contain the initial product P from which the final product B can be obtained.

The casing 2 is compressible and/or crushable and/or deformable, obtained by forming of a thermoformable material sheet, in particular a liquid- and gas-impermeable multilayered plastics and suitable for contact with foodstuffs.

To allow the casing 2 to be compressed and crushed along a direction A almost parallel to a longitudinal axis of the capsule 1 and substantially orthogonal to the base wall 3, the side wall 4 is deformable and/or compressible along preset pliability lines, for example, having a helicoidal trend, or it is made in the shape of an accordion or of a bellows, as in the embodiment illustrated in FIG. 12.

Furthermore, the side wall 4 is divergent starting from the base wall 3 to a peripheral flange-shaped edge 6, for example, having an almost frusto-conical shape.

The base wall 3 is, for example, concave in the direction of the cavity 5.

The capsule 1 comprises a nozzle 107 associated with the casing 2 arranged to introduce a fluid F into the cavity 5, in particular a pressurized hot liquid, for example water, capable of interacting with the initial product P to obtain the final product B.

The nozzle 107 comprises an elongated and rigid tubular member, having a longitudinal side wall 110, a first end 108, and a second end 109 mutually opposite. The first end 108 is provided with a first opening 113 arranged to engage with an injecting arrangement of a brewing machine capable of delivering the fluid F, while the longitudinal side wall 110 is provided with at least one outflow opening 111 that is flowingly connected, via a first duct 114, to the first opening 113 and it is arranged to introduce the fluid F into the cavity 5 in an injecting step J, as best described in the following description.

In a non-illustrated version of the capsule 1, the nozzle is provided with a plurality of outflow openings 111 arranged to deliver into the cavity 5 respective fluid jets L.

The second end 109 is provided with a second opening 116 flowingly connected, via a second duct 117, to a delivering opening 118 made on the longitudinal side wall 110. The delivering opening 118, the second duct 117, and the second opening 116 allow the final product B to exit the cavity 5 and to be delivered directly into a fruition container in a delivering step E, as best described in the following description.

The first duct 114 and the second duct 117 are placed side by side, in particular, they are parallel to one another and to a longitudinal axis X of the nozzle 107, and extend substantially over the entire length of the latter. In the illustrated embodiment, the outflow opening 111 is made in the proximity of the second end 109, while the delivering opening 118 is made in the proximity of the first end 108.

Figure 2:
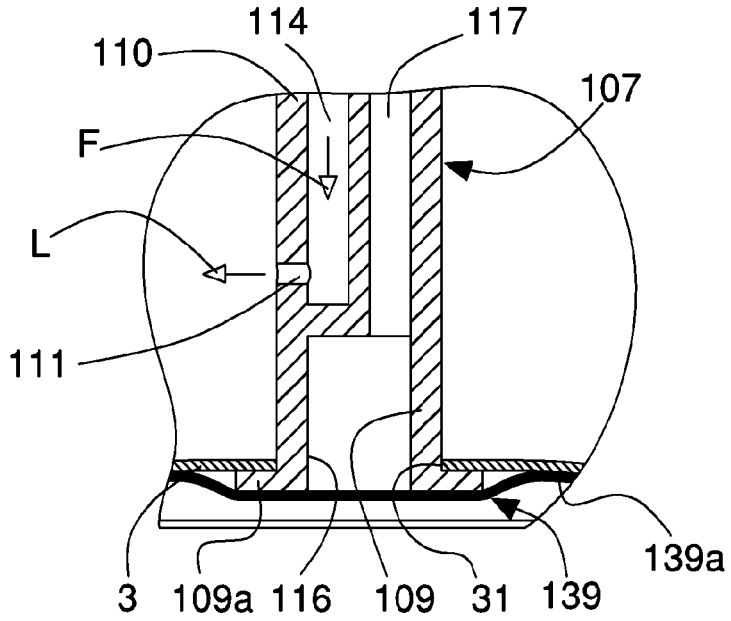
FIG. 2 is an enlarged detail of the capsule in FIG. 1.

With particular reference to FIG. 2, in an initial configuration K of the capsule 1, in which the casing 2 is not compressed nor crushed, the nozzle 107 is arranged inside the cavity 5 with the second end 109 partially exiting the above-mentioned cavity 5 through an exit opening 31 made in the base wall 3. The nozzle 107 inserts and can slide with interference (thus making a hydraulic sealing) in the exit opening 31: in such a manner, as best explained in the following description, the final product B may exit the capsule 1 only through the nozzle 107, and in particular through the delivering opening 118, the second duct 117, and the second opening 116.

The second end 109 of the nozzle 107 has an external flange 109*a* peripherally surrounding the second opening 116. In an initial configuration K of the capsule 1, the external flange 109*a* abuts against an external surface of the base wall 3.

A closing element 139 is provided to hermetically close the second opening 116 of the nozzle 107 and insulating from the external environment the cavity 5. The closing element 139, for example in the shape of a disc, comprises a joining, for example annular, edge, 139*a* by which it is removably fixed to an external surface of the base wall 3. The closing element 139 may be easily detached from the base wall 3 in an automatic manner by the nozzle 107 in an initial partial crushing step of the casing 2, or again by the pressure of the air contained inside the cavity 5, which is in turn pushed to the outside by the introduction of the fluid F into the capsule during the injecting step J.

The closing element 139 may be further easily detached from the base wall 3 manually by a user before the insertion of the capsule 1 into the brewing machine, and in this case it is provided, according to a preferred embodiment, with an elongated tab 139*b* extending outwardly starting from a connecting portion of the joining edge 139*a*.

The closing element 139, provided with or devoid of the tab 139*b*, is made of plastics, or aluminum, weldable, for example thermally or by ultrasounds, and the joining edge 139*a* is, in particular, fixed to the external surface of the base wall 3 by a first portion 239*a* by a blocking seal and by a second portion 239*b* by a peelable seal, the blocking seal requiring a greater force compared to the peelable seal to detach the joining edge 139*a* from the base wall 3, so as to promote the release of the second portion 239*b* of the joining edge 139*a* before releasing the first portion 239*a*.

The first portion 239*a* extends in a first angular interval comprised between 80° and 100°, in particular 100°, and the second portion 239*b* extends in a second angular interval that is explementary to the first angular interval, in other words, the first portion 239*a* and the second portion 239*b* extend over the entire joining edge 139*a*.

If the closing element 139 is provided with the elongated tab 139*b*, the connecting portion of the joining edge 139*a* extends from the first portion 239*a* fixed by the blocking seal, due to reasons that will be best seen herein below.

The second portion 239*b*, fixed by a peelable seal, comprises a detachment promoting arrangement to promote a gradual and progressive separation of the joining edge 139*a* from the base wall 3, which comprise at least one detachment portion 240, at which the second portion 239*b* has substantially a "V", or wedge, shape.

In particular, the detachment promoting arrangement comprises a plurality of detachment portions 240 angularly equidistant in the second portion 239*b*, as shown in FIG. 12, to distribute the efficiency of such release along the entire second portion 239*b*.

On the contrary, the first portion 239*a* fixed by the blocking seal is devoid of the detachment promoting arrangement, and, therefore, although both the blocking seal and the peelable seal allow removably fixing the closing element 139 to the base wall 3, the blocking seal requires a greater force compared to the peelable seal to allow the release of the first portion 239*a* with respect to the second portion 239*b*.

If the tab 139*b* is present, and only one detachment portion 240 (not illustrated) is present, the latter is located in the second portion 239*b* along a symmetry axis S of the tab 139*b*, on the opposite side with respect to the tab 139*b*.

In this manner, when the closing element 139 is pushed by the nozzle 107 and detached in an automatic manner, the first portion 239*a* remains connected to the base wall 3 and acts as a hinge element about which the portion of the closing element 139 comprising the second portion 239*a* of the joining edge 139*a* may rotate, away from the base wall 3.

According to a non-illustrated embodiment, the closing element 139 may be removably fixed to the external flange 109*a* so as to hermetically close the second opening 116. In this case, the closing element has to be manually detached by the user before inserting the capsule 1 into the brewing machine.

The capsule 1 further comprises a covering element 19 that is fixed to the edge 6 of the casing 2 to hermetically close the cavity 5. The covering element 19 is perforable, in particular by the injecting arrangement of the brewing machine, to allow the injecting arrangement to engage the first opening 113 of the nozzle 107 and introduce the fluid F into the capsule through the nozzle 107.

The covering element 19 is fixed by means of a welding also to the first end 108 of the nozzle 107, collaborating with the exit opening 31 to keep the above-mentioned nozzle 107 in place inside the cavity 5, and above all creating a fluid seal between the covering element 19 and the above-mentioned first end 108. In this manner, the fluid F received from the nozzle 107 in the first opening 113 is delivered to the containing cavity of the product P only through the outflow opening 111 and undesired leaks of the fluid F at the first end 108 are avoided.

Both the closing element 139 and the covering element 19 are made of selected materials, for example, multilayered plastic polylaminates, so as to protect over time from moisture and oxygen the initial product P contained in the capsule. Such multilayered plastics may for example contain aluminum or a different barrier layer, for example, ethylene vinyl alcohol (EVOH) or polyvinylidene chloride (PVDC). If they contain, for example, aluminum, they cannot be considered as recyclable plastics, therefore they have to be divided from the remaining plastics composing the capsule to the aims of waste disposal.

The operation or use of the capsule 1 of the invention in an automatic brewing machine provides for an initial step of partial crushing of the casing 2 to allow the nozzle 107, slidable with interference in the exit opening 31, further exiting the latter, at least partially detaching the closing element 139. In fact, the portion of the closing element 139 comprising the second portion 239*b* rotates away from the base wall 3 about the first portion 239*a*, still connected to the base wall, acting as a hinge line of the closing element 139.

Figure 4:
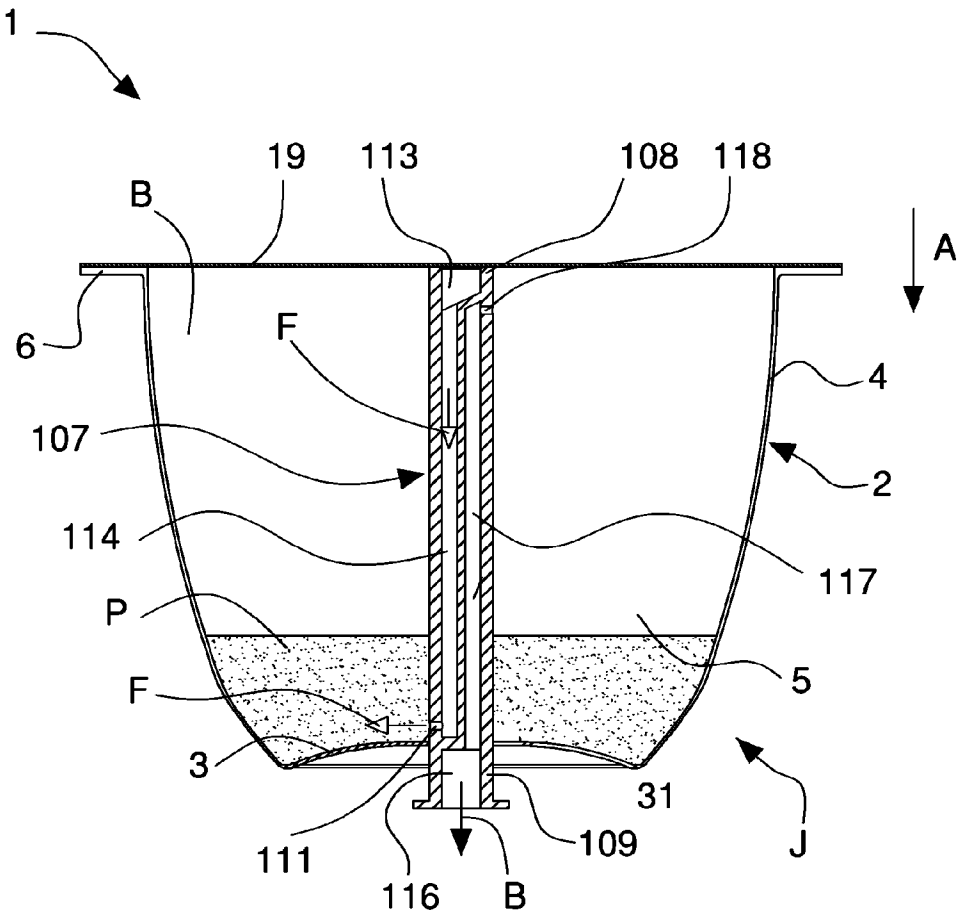
FIG. 4 is a cross-section of the capsule in FIG. 1 in an initial compressing and injecting step of a fluid.

The detachment, even if partial, of the closing element 139 puts the cavity 5 flowingly connected with the external environment, through the delivering opening 118, the second duct 117, and the second opening 116. In this manner, the air contained inside the capsule 1 may freely exit when, in the successive injecting step J, the fluid F is introduced into the cavity 5 through the outflow opening 111 of the nozzle 107. The nozzle 107 exits the capsule 1 by a reduced amount, so as to ensure that the outflow opening 111 remains anyhow inside the cavity 5 to introduce the fluid F inside the latter (FIG. 4).

The nozzle 107 is supplied by an injecting arrangement of the brewing machine capable of perforating the covering element 19 and engaging the first opening 113.

Alternatively, the closing element 139 may be manually removed by the user before inserting the capsule 1 into the brewing machine. In this case, the casing 2 needs not to be partially compressed and crushed before and/or during the injecting step J of the fluid F.

In the injecting step J, the fluid F inserted through the nozzle 107 may interact with the initial product P to gradually form the final product B. In this step, the casing 2 of the capsule 1 is partially crushed (to allow as illustrated above the nozzle detaching the closing element 139) and the second end 199 of the nozzle 107 is engaged, seal fit in the exit opening 31. Since the delivering opening 118 is in the proximity of the first end 108 of the nozzle 107, the fluid F, the mixture of fluid and initial product P, and the final product B progressively forming on the bottom of the capsule 1, cannot exit externally to the latter through the second opening 116.

The pressure and temperature of the fluid F introduced into the cavity 5 have to be suitably adjusted as a function of the type and composition of the initial product P.

Once the cavity 5 has been completely filled with the fluid F interacting with the initial product P to form the final product B, it is possible to deliver the latter in a delivering step E directly into a fruition container that is suitably arranged.

The delivering step may be implemented by progressively compressing and crushing the casing 2 along the direction A so as to allow the nozzle 107 to further exit the cavity 5 through the exit opening 31, and above all so as to force the final product B to exit the cavity 5 through the delivering opening 118, the second duct 117, and the second opening 116. Since the longitudinal side wall 110 of the nozzle 107 abuts against with interference and then sealingly slides in the exit opening 31, and since the cavity 5 is closed, by crushing and compressing the casing 2 the final product B contained therein is in fact forced by the pressure to enter the delivering opening 118 and exit the capsule 1 through the second duct 117 and the second opening 116.

When the outflow opening 111 of the nozzle 107 is outside of the capsule 1, during the progressive crushing of the casing 2 and the consequent progressive exit of the nozzle 107, it is possible to further deliver directly into the fruition container also the fluid F. More precisely, the nozzle 107 allows delivering at the same time the fluid F (through the first duct 114 and the outflow opening 111) and the final product B (through the second duct 117 and the second opening 116) so as to further dilute the latter and to make a desired dose of final product. Such operation, which with the known capsules has to be implemented manually by the user, may be instead carried out in an automatic manner by the brewing machine using the capsule 1 of the invention.

It shall be noticed that the capsule 1 of the invention allows delivering into the container only the final product B (during the delivering step E) at the end of the solubilization and/or dissolution thereof. In fact, the configuration of the nozzle 107 prevents also the accidental exit of the fluid F from the capsule 1 during the preparation step of the final product B.

Alternatively, the delivering step E may be initially carried out by continuing to inject the fluid F into the cavity 5, thus forcing the final product B to exit due to the action of the pressure from the capsule 1. Subsequently, by completely compressing and crushing the casing 2, the complete outflow of the final product B from the capsule is made.

It shall be noticed that also with such delivering mode, it is possible to dilute the final product B and make a desired final amount thereof that is greater than the capsule capacity.

Such operation, which with the known capsules has to be carried out manually by the user, may be instead carried out in an automatic manner by the brewing machine using the capsule 1 of the invention.

At the end of the delivering operation, a user may manually complete the removal of the covering element 19 (and to such aim, in a non-illustrated embodiment, the covering element could also be provided with an elongated tab) and/or of the closing element 139, in order to separate components in recyclable plastics, as surely the casing 2 and the nozzle 107 are, from non-recyclable components, as could be the covering element 19 and/or the closing element 139 if they are made in a multilayered plastics containing for example aluminum.

As regards the closing element 139, the user may separate it from the capsule 1 by grasping the portion already detached of the closing element 139 comprising the second part 239*b* or the user may, if present, grasp the tab 139*b* connected to the first part 239*a* of the joining edge 139 thus avoiding getting contaminated and/or wetted in case the above-mentioned already detached portion contacted during the delivering operation the final product B.

Therefore, it is possible to define a method to produce a final product B using the capsule 1 of the invention in an automatic brewing machine, comprising the following steps:

- introducing, in an injecting step J the fluid F inside a cavity 5 of the capsule 1 through the first opening 113, the first duct 114 the outflow opening 111 of the nozzle 107 so that the fluid F interacts with the initial product P contained in said capsule 1;
- delivering the final product B so obtained directly into a fruition container in a delivering step E through at least the delivering opening 118, the second duct 117 and the second opening 116 of the nozzle 107, said delivering comprising continuing to introduce the fluid F in the cavity 5 and/or progressively compressing and crushing the casing 2 of the capsule 1 so as to force the final product B to exit by pressure from the cavity 5 through the delivering opening 118, the second duct 117 and the second opening 116.

Before introducing the fluid F, it is further provided to remove the closing element 139 fixed to the hermetic seal capsule 1 of the second opening 116 of the nozzle 107, said removal comprising partially compressing and/or crushing the casing 2 so as to force the nozzle 107 to further exit the cavity 5 and at least partially detaching the closing element 139.

It is worth noting that the capsule 1 of the invention allows delivering the final product B directly in a fruition container without the need of performing the perforation of the base wall 3. The nozzle 107 exiting the cavity 5 through the exit opening 31 of the base wall 3 allows the controlled exit of the final product B through the delivering opening 118, the second duct 117 and the second opening 16 directly into the fruition container during the delivering step.

Therefore, the capsule 1 of the invention may be used in a brewing machine not provided with a delivering circuit, since such capsule does not require an extracting arrangement suitable to perforate the bottom of the capsule to allow the exit of the final product, nor a duct arrangement to convey such final product into the fruition container (for example, a mug, a cup, a glass, etc.).

The absence of the delivering circuit makes the brewing machine simpler and more inexpensive, and it further ensures the hygiene of the delivering process and the maintenance of the quality of the delivered beverages, since contaminations between beverages delivered at later moments are not possible.

Another advantage of the capsule 1 of the invention is that it prevents that the injecting arrangement of the brewing machine contacts the initial product P and/or the mixture/final product B in the preparation step and, subsequently, in the delivering step. In fact, the nozzle 107 of the capsule 1 is arranged to be engaged, by the first opening 113 of the first end 108, by the injecting arrangement of the brewing machine. In such a manner also by virtue of the covering element 19 welded to the nozzle 107 at the first end 108, the injecting arrangement, also when they are inserted in, and engaged to, said first opening 113 are separated and insulated from the cavity 5 and the initial product P. Thus the supply circuit of the machine, comprising the injecting arrangement, is not contaminated or polluted by the initial and/or final product, this ensuring the hygiene of the delivering process and the quality of the final products at each delivering operation. A further advantage of the capsule 1 is that it does not require a special sealed package, since the covering element 19 and the closing element 139 hermetically insulate the cavity 5 from the external environment so as to preserve the initial product P.

Figure 6:
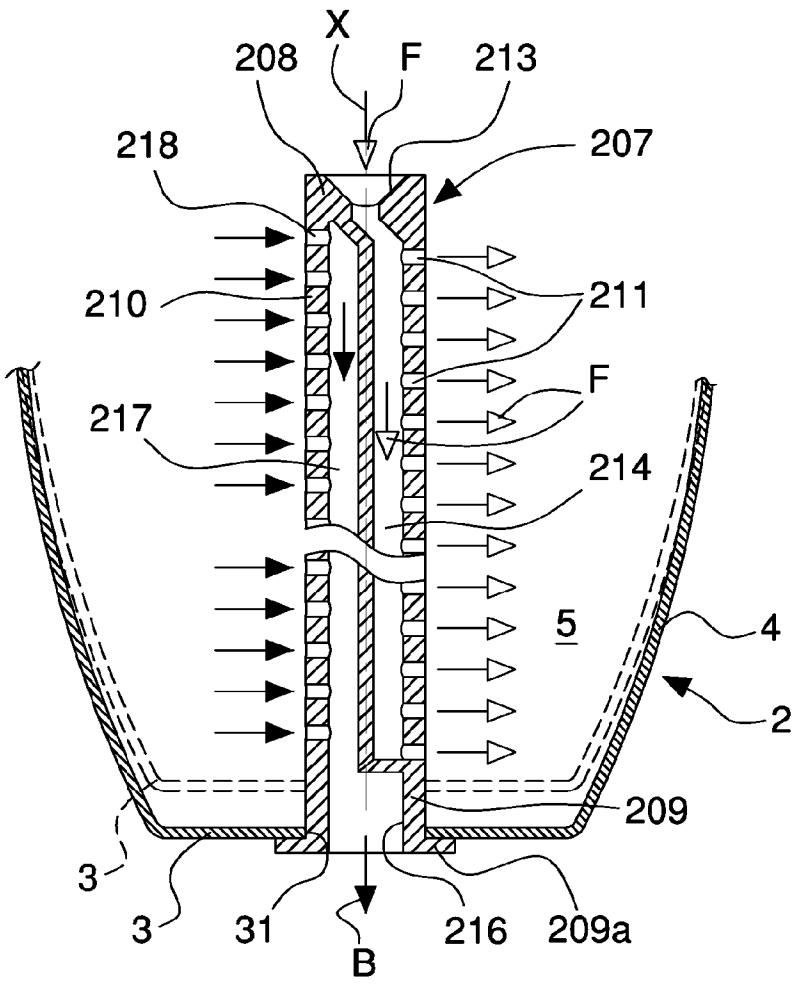

FIG. 6 illustrates a version of the capsule 1, differing from the embodiment described above and referred to in the FIGS. 1 to 5, since it comprises a respective nozzle 207, having a shape similar to the nozzle 107, having a respective longitudinal side wall 210, a respective first end 208, and a respective second end 209 mutually opposite. The nozzle 207 comprises a plurality of respective outflow openings 211 made mutually spaced apart along the longitudinal side wall 210 substantially over the entire length of the latter and connected by a respective first duct 214 to a respective first opening 213 with which the first end 208 is provided. The nozzle 207 also includes a plurality of respective delivering openings 218 made mutually spaced apart along said longitudinal side wall 210 substantially over the entire length of the latter and connected by a respective second duct 217 to a respective second opening 216 with which the second end 209 is provided. The outflow openings 211 and the delivering openings 218 are substantially opposite. The nozzle 207 comprises a respective external flange 209*a*, similar to the external flange 109*a* in FIG. 3.

Such capsule is in particular suitable for use with an initial product P to be percolated, typically coffee powder. In fact, the outflow openings 211 allow the fluid F percolating in a substantially even and complete manner through the mass of initial product contained in the cavity 5. The delivering openings 218, suitably sized, allow the exit of the final product B (percolate), holding and preventing the exit of the initial product P.

The operation or use of this version of capsule 1 of the invention in an automatic brewing machine provides for an initial step of partial crushing of the casing 2 (represented in FIG. 6 in dotted line) to allow the nozzle 207 at least partially detaching the closing element 139 (thus connecting the cavity 5 to the external environment through the delivering openings 218, the second duct 214, and the second opening 216) and above all for compressing and compacting the initial product P inside the capsule 1. The extent of the crushing of the casing 2 is calculated to ensure a compaction of the initial product P that prevents the formation of preferential passage pathways of the fluid F during the percolation so as to make a final beverage B (coffee) with a high quality and satisfactory organoleptic characteristics. It is also possible to use a compressible and crushable casing 2 obtainable in thermoformable plastics with a reduced cost.

The injecting step and the delivering step in this case coincide, since while the fluid F is injected and exits into the cavity 5 through the outflow openings 211, the final product B made from the percolation exits the cavity through the delivering openings 218. It shall be noticed that the nozzle 207 acts as a filter, allowing the exit of the final product B directly delivered into the fruition container and holding inside the capsule the percolated initial product.

A method to produce the final product B by using, in an automatic brewing machine, the version of capsule described above, comprises the steps of:

- compressing and crushing the casing 2 to compress and compact an initial product P to be percolated, in particular coffee powder contained in the capsule;
- inserting, in an injecting step J, the fluid F inside the cavity 5 of the capsule 1 through the first opening 213, the first duct 214, and the outflow openings 211 of the nozzle 207 so as to make, in particular by percolation, the fluid F to interact with the initial product P and make the final product B;
- delivering the final product B directly in a fruition container in a delivering step E through the delivering openings 218, the second duct 217, and the second opening 216 of the nozzle 207, said delivering comprising continuing to inject the fluid F into the cavity 5 so as to force the final product B to exit by pressure from the cavity 5 through the delivering opening 218, the second duct 217, and the second opening 216.

Figure 7:
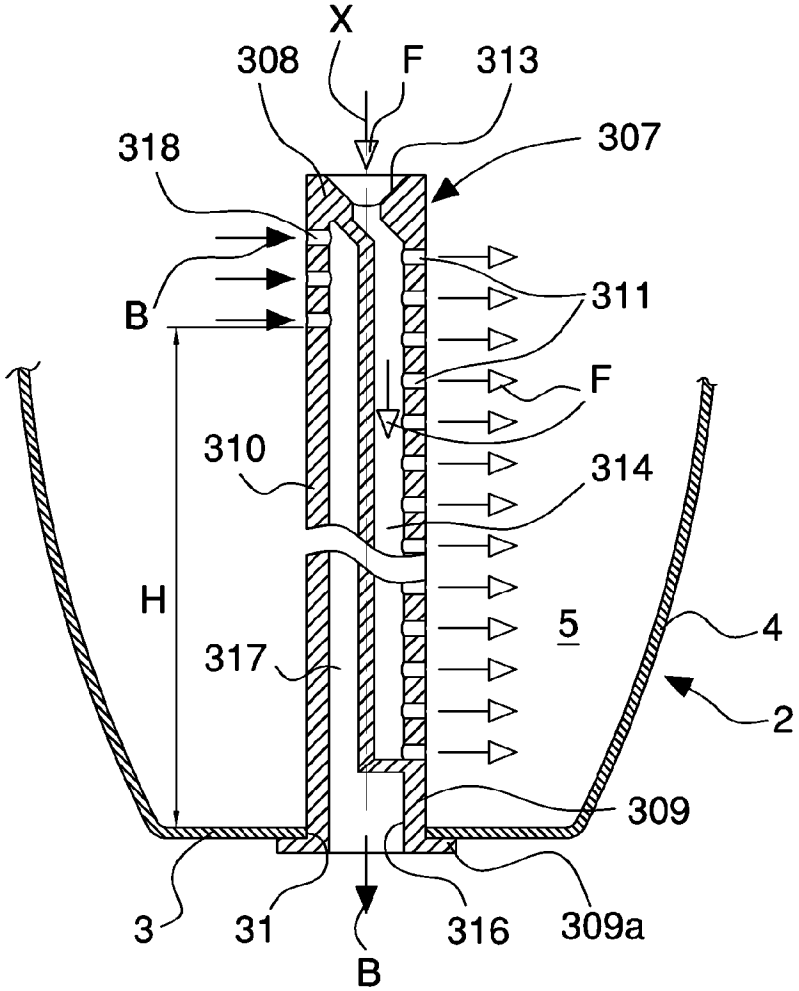

FIG. 7 illustrates a version of the capsule 1 differing from the capsule in FIG. 6 since it comprises a respective nozzle 307, similar to the nozzle 207 in FIG. 6, having a respective longitudinal side wall 310, a respective first end 308, and a respective second end 309 mutually opposite.

Figure 3:
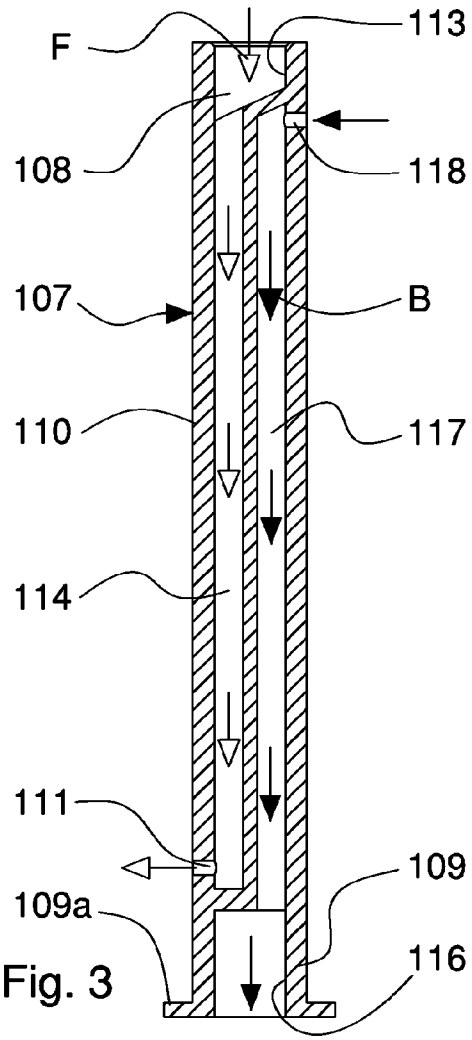
FIG. 3 is a cross-section of a nozzle of the capsule in FIG. 1.

The nozzle 307 comprises a respective external flange 309*a*, similar to the external flange 109*a* in FIG. 3.

The nozzle 307 comprises a plurality of respective outflow openings 311 made mutually spaced apart along the longitudinal side wall 310 substantially over the entire length of the latter, and a plurality of respective delivering openings 318 made mutually spaced apart along said longitudinal side wall 310, but arranged only in the proximity of the first end 308 at a preset distance H from the base wall 3 of the casing 2, unlike what has been described for the nozzle 207. The nozzle 307 comprises a respective external flange 309*a*, similar to the external flange 109*a* in FIG. 3.

Such capsule is in particular suitable for use with an initial product P for infusion. The delivering openings 318, suitably sized, allow the exit of the final product B, holding and preventing the exit of the initial product P (e.g. tea leaves) only when the casing 2 is compressed and crushed, allowing a pre-infusion step of the initial product comprised between the injecting step of the fluid and the delivering step. More precisely, the operation or use of this version of capsule 1 of the invention in an automatic brewing machine provides for:

- an initial step of partial crushing of the casing 2 to allow the nozzle 307 at least partially detaching the closing element 139 and thus connecting the cavity 5 with the external environment;
- an injecting step J in which a fluid F is introduced into the cavity 5 through the outflow openings 311 until reaching a level H below the height of the delivering openings 318;
- a pre-infusion step with a variable duration as a function of the initial product P that allows making by infusion the final product (tea);
- a delivering step in which the casing 2 is compressed and crushed to allow the exit of the final product B from the capsule 1 through the delivering openings 311, the second duct 317, and the second opening 316 of the nozzle 307, directly into the fruition container.

After the pre-infusion step, and before the delivering step, it is possible to inject further fluid F into the cavity 5 through the outflow openings 311. This allows diluting the final product B before the crushing of the casing 2 and making a final desired amount thereof greater than the capacity of the capsule 1. Such operation, that with the known capsules has to be performed manually by the user, may be instead performed in an automatic manner by the brewing machine using the capsule 1 of the invention.

FIG. 8 illustrates another version of the capsule 1 differing from the illustrated embodiment in the FIGS. 1 to 5, since it comprises a respective nozzle 407, having a respective longitudinal side wall 410, a respective first end 408, and a respective second end 409 mutually opposite. The nozzle 407 comprises a pair of respective opposite outflow openings 411, in particular substantially aligned, and made on the longitudinal side wall 410 at the first end 408, and a pair of respective opposite delivering openings 418, in particular substantially aligned, and made on the longitudinal side wall 410 adjacent to the outflow openings 411, interposed between the latter ones and the second end 409 at a preset distance from the base wall 3 of the casing 2. The outflow openings 411 are flowingly connected with a respective first opening 413 with which the first end 408 is provided by a respective first duct 414, while the delivering openings 418 are flowingly connected with a respective second opening 416 with which the second end 409 is provided by a respective second duct 417. In this version, the first duct 414 and the second duct 417 are superimposed and substantially aligned to the longitudinal axis X of the nozzle 407. The nozzle 407 comprises a respective external flange 409*a*, similar to the external flange 109*a* in FIG. 3.

The nozzle 407 further comprises a respective annular projection 425, arranged adjacent to the delivering openings 418, between the latter ones and the second end 409. The annular projection 425 radially projects from the longitudinal side wall 410 and it is arranged to abut against the base wall 3 and prevent the complete crushing of the casing 2 so as to keep the outflow openings 411 and the delivering openings 418 inside the capsule 1 throughout the delivering step.

The annular projection 425 acts as a stroke stop when crushing of the casing 2 and prevents the complete exit of the nozzle 407 from the capsule 1. The tests performed showed that this capsule is particularly versatile, since it is suitable for use with a soluble initial product P, for example a soluble powder, or with a concentrated liquid, or with an initial product P for infusion.

The annular projection 425 could be applied also to the versions of the capsule 1 of the invention illustrated in the remaining Figures, and not only to the version in FIG. 8. The operation or use of this version of capsule 1 of the invention in an automatic brewing machine provides for an initial step of partial crushing of the casing 2 to allow the nozzle 407, and in particular the external flange 409*a*, at least partially detaching the closing element 139 and thus connecting the cavity 5 with the external environment, through the delivering opening 418, the second duct 417, and the second opening 416.

In the injecting step J, the fluid F is introduced into the cavity 5 through the outflow openings 411 so as to interact with the initial product P. In an initial mixing step of the fluid F with the initial product P, the distance of the delivering openings 418 from the base wall 3 prevents the exit of not perfectly solubilized and/or diluted and/or infused fluid and product. The delivering step starts when the already solubilized, diluted and/or infused final product B reaches the height of the delivering openings 418. In the case where a product for infusion is present, a pre-infusion step or pause may be provided for, with a variable duration as a function of the initial product P that allows making by infusion the final product (tea).

At this point, the casing 2 may be compressed and crushed to allow the exit of the final product B.

By virtue of the configuration of the nozzle 407, also during the crushing of the casing 2 (and at the end of the crushing by virtue of the annular projection 425), it is possible to continue introducing fluid F inside the cavity 5 through the inflow openings 411 so as to continue to solubilize and/or dilute the initial product P. The annular projection 425, acting as a stroke stop for the crushing of the casing 2, ensures that the delivering, i.e., the exit of the final product B from the capsule 1, always occurs through the second opening 416 of the nozzle 407.

Figure 9:
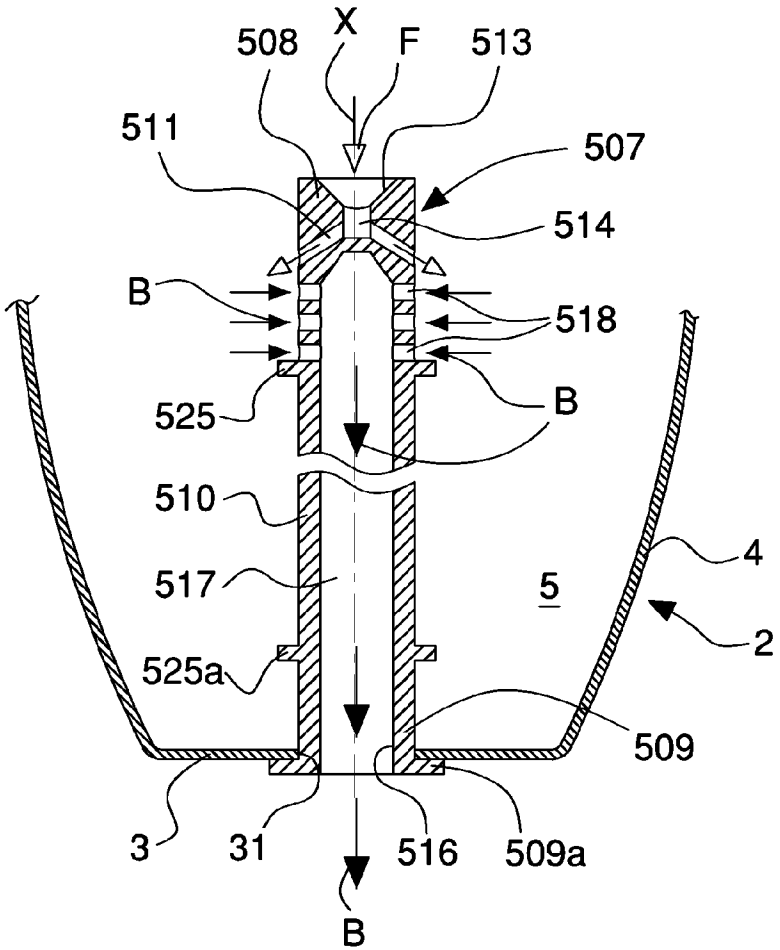

FIG. 9 illustrates a further version of the capsule 1 differing from the capsule in FIG. 8 in that it comprises a respective nozzle 507, similar to the nozzle 407 in FIG. 8, having a respective longitudinal side wall 510, a respective first end 508, and a respective second end 509 mutually opposite. The nozzle 507 comprises a pair of respective outflow openings 511 arranged opposite at the first end 508 of the nozzle 507 and inclined, for example by an angle ranging between 20° and 45° and in particular 30° with respect to the longitudinal side wall 510, so as to direct respective jets of fluid F towards the base wall 3. The nozzle 507 further comprises a plurality of respective delivering openings 518 made mutually spaced apart and opposite along the longitudinal side wall 510 for a limited length and interposed between the outflow openings 511 and the base wall 3. The outflow openings 511 are flowingly connected with a respective first opening 513 by a first duct 514, while the delivering openings 518 are flowingly connected with a respective second opening 516 by a second duct 517. The first duct 514 and the second duct 517 are superimposed and substantially aligned to the longitudinal axis X of the nozzle 507. The nozzle 507 comprises a respective external flange 509*a*, similar to the external flange 109*a* in FIG. 3.

In a similar manner to what has been stated for the annular projection 425 of the nozzle 407, the nozzle 507 comprises a respective annular projection 525, arranged adjacent to the delivering openings 518, between the latter ones and the second end 509, acting as a stroke stop when crushing of the casing 2 and prevents the complete exit of the nozzle 507 of the capsule 1.

It is further provided a further annular projection 525*a* that also projects from the longitudinal side wall 510 configured to act as an intermediate stroke stop in the initial step of partial crushing of the casing 2 along the direction A. In particular, the further annular projection 525*a* is near to the external flange 509*a*. In particular, the further annular projection 525*a* is located at a distance from the external flange, measured parallel to the crushing direction A such as to allow, in such initial crushing step of the casing 2, the at least partial detachment of the closing element 139 from the base wall 3 of the casing 2 by the external flange 509*a*. More precisely, the distance from the external flange 509*a* at which the further annular projection 525*a* is located is sufficient to allow the nozzle 507 at least partially detaching the closing element 139 from the base wall 3 of the casing 2, while maintaining the closing element 139 in a preset position during a pause step having a variable duration, such as, for example the mixing and/or pre-infusion, such position being such as not to hinder the successive exit of the final product B.

The further annular projection 525*a* is of such dimensions as not to prevent the further exit of the nozzle 507 from the capsule to the stroke stop annular projection 525, in a successive compression and crushing step of the casing 2.

Such further annular projection 525*a* could be also applied to the versions of the capsule 1 of the invention illustrated in the remaining figures, and not only to the version in FIG. 9. The operation or use of this version of capsule 1 is substantially similar to that of the capsule in FIG. 8. The inclined outflow openings 511 allow better directing the fluid F against the initial product P laying on the base wall 3 so as to move it, mix, more easily dissolve, or extracting the aromatic characteristics of the products for infusion. The delivering of the final product B is promoted by the number of delivering openings 518. The tests performed showed that this version of capsule is in particular versatile and is indicated for initial products comprising soluble powders, freeze-dried products, liquid concentrates or with an initial product P for infusion.

Figure 9C:
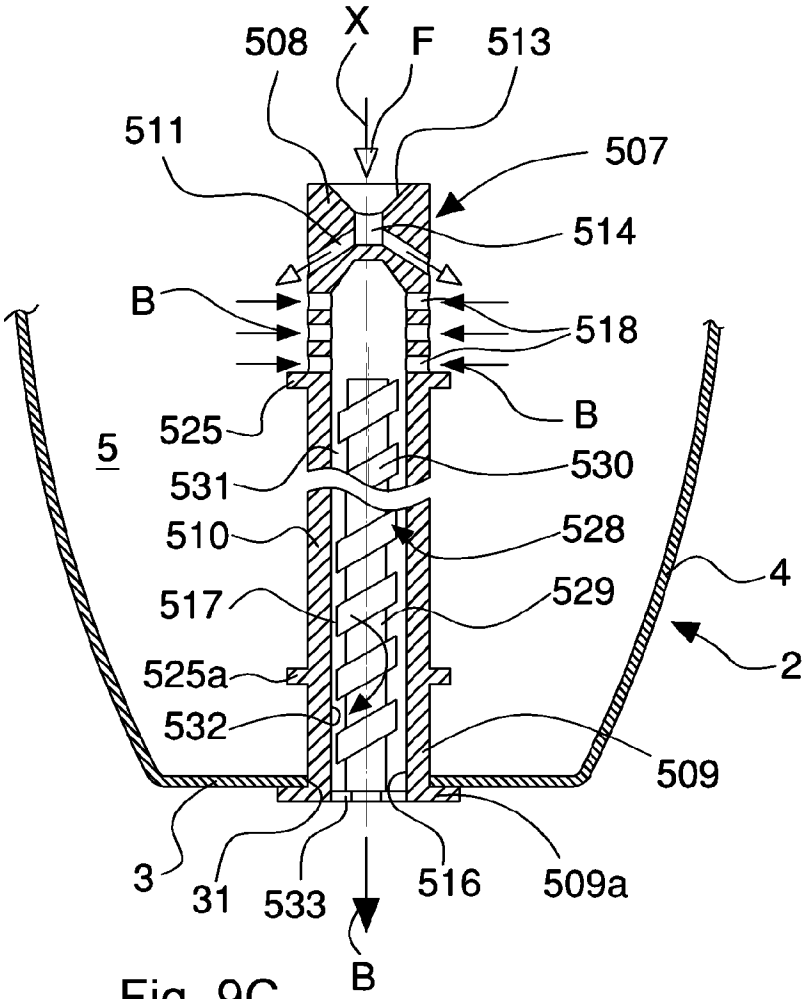
Figure 9B:
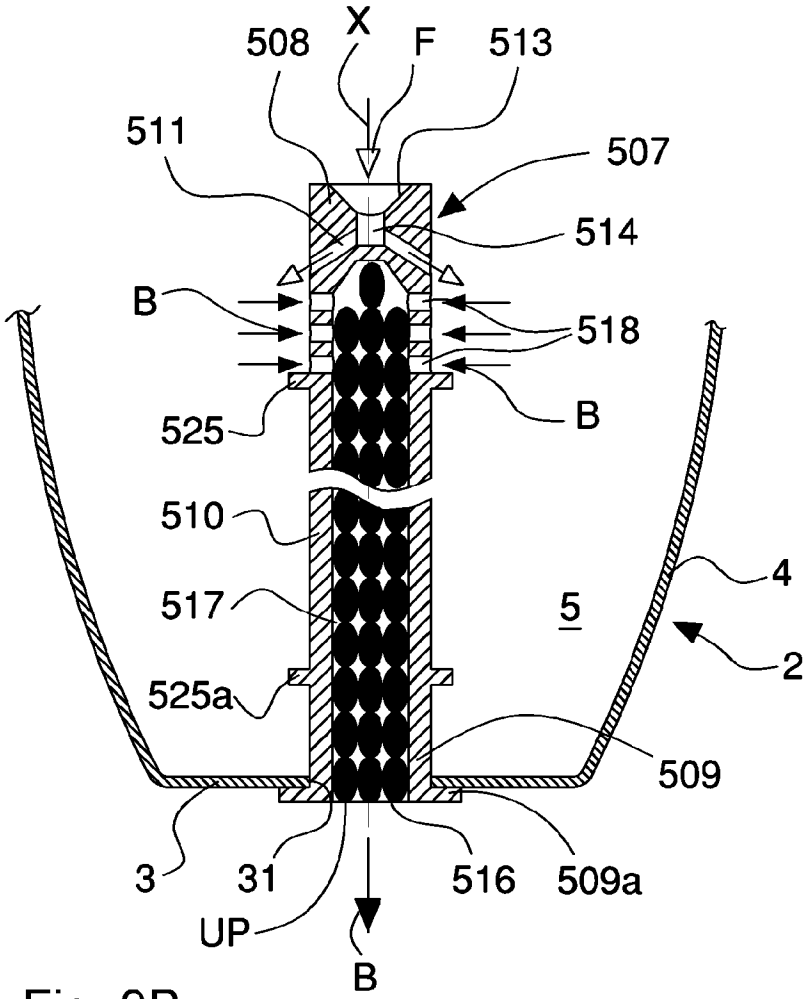

FIG. 9*b* illustrates a further version of the capsule 1 differing from the capsule in FIG. 9 in that it comprises a solid product UP, schematically illustrated, contained in the second duct 517 and deliverable directly into a fruition container through the second opening 516 before the delivering step E.

The solid product UP may be soluble or not soluble, and it is intended to be consumed together with the final product B.

The solid product UP may be composed of only one element (for example, a cookie, or a crouton or a piece of bread), or by a plurality of elements, such element(s) having at least one dimension (length, width, or height) that is greater than, or the same as, a width of the delivering opening 518, so that the delivering opening 518 prevents such solid product UP exiting the second duct 517 towards the cavity 5. In such a manner, the solid product UP remains inside the second duct 517 separated from the initial product P all the time that the capsule 1 remains unused.

In particular, the solid product UP may comprise multiple elements that are homogenous to each other, i.e., of the same type, such as, for example sweeteners, or cereals, colored or not, or croutons, and the like, or a plurality of elements that are mutually non-homogenous, for example, a mixture of sweeteners and cereals.

The solid product UP may be inserted into the capsule 1 in the production line, this reducing and simplifying a product storehouse. This further allows diversifying, in a packaging step, capsules 1 containing a same initial product P. In fact, in the packaging step it is possible to add to the capsules 1 containing a same initial product P, a plurality of different solid products UP. For example, it is possible to add to the capsule 1 containing a same product P, a solid product UP composed of a sweetener, or a solid product UP composed of cereals.

The operation or use of this version of capsule 1 in an automatic brewing machine is substantially similar to that of the capsule in FIG. 9 as regards the preparation of the final product B. In addition, the capsule in FIG. 9*b* allows using the solid product UP.

The solid product UP may be delivered directly into the fruition container in an automatic manner. According to such manner, the step of partial crushing of the casing 2 allows the nozzle 507 at least partially detaching the closing element 139, so as to connect the second duct 517 to the external environment via the second opening 516, and allow the exit of the solid product UP from the second duct 517 towards the fruition container.

Alternatively, the solid product UP may be delivered directly into the fruition container in a manual manner. According to such manner, the closing element 139 is manually detached from the base wall 3 by a user before inserting the capsule 1 into the brewing machine. The user, at discretion, may determine the amount of solid product UP to be delivered into the fruition container, for example, in the case that the solid product UP is a sweetener, to obtain a sweeter or less sweet final product B. Of course, in a manual manner, the user may also decide not to use the solid product UP at all. In this case, the user has only to remove the solid product UP from the second duct 517 without inserting it into the fruition container.

It is added that the solid product UP could be provided, inside the respective second ducts, also in the versions of the capsule 1 of the invention illustrated in the remaining Figures, and not only in the version in FIG. 9*b*.

Figure 1:
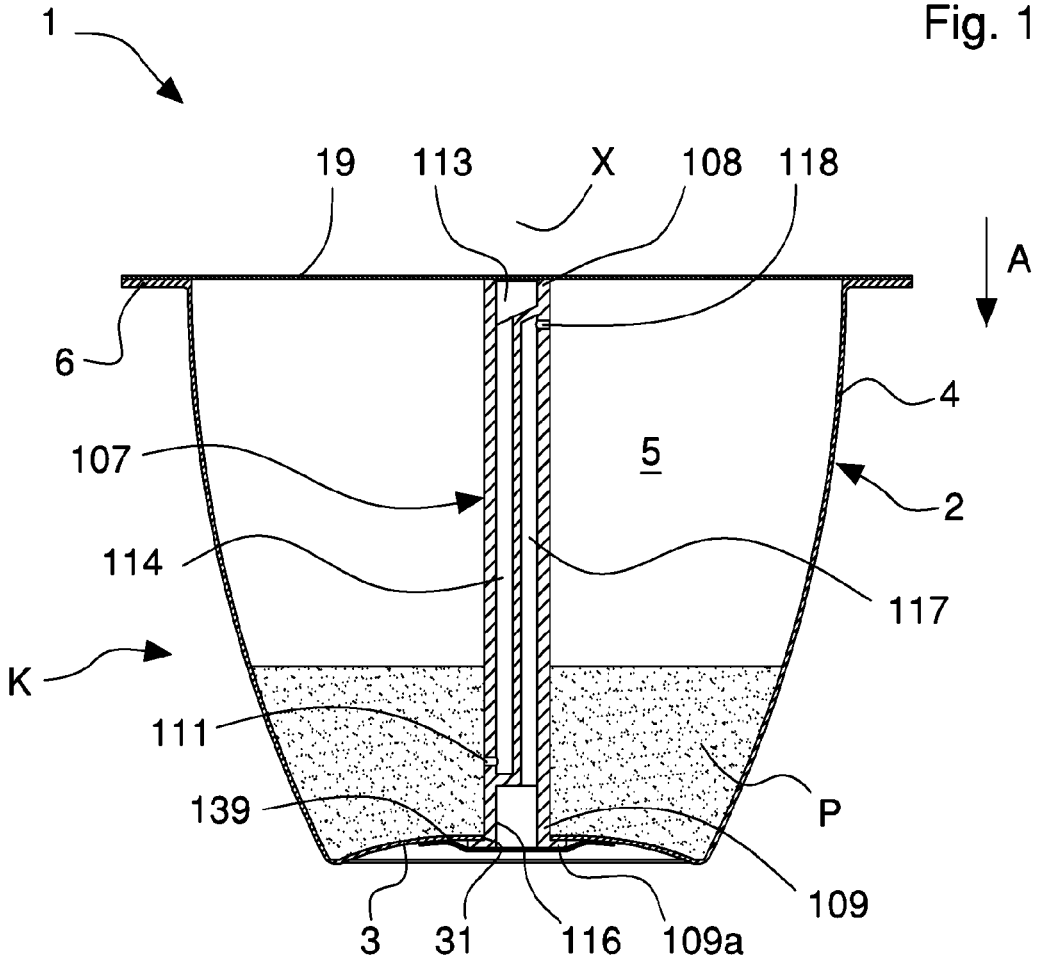
FIG. 1 is a cross-section of the capsule according to the invention.
Figure 2B:
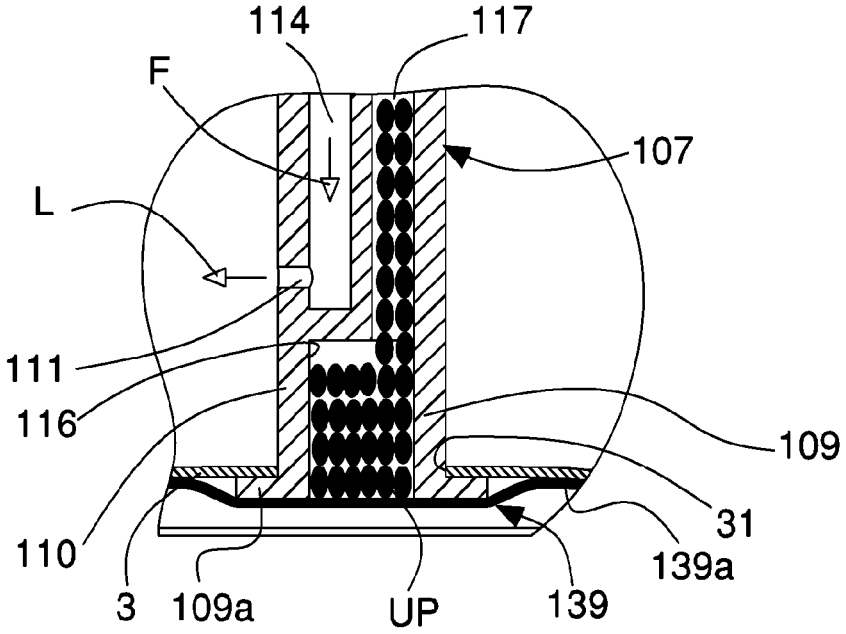
FIG. 2*b* is an enlarged detail of a version of the capsule in FIG. 1, in which a second duct comprises a solid product.

FIG. 2*b* shows for example a different version of the capsule 1, differing from the capsule in FIG. 1 in that it comprises the solid product UP contained in the second duct 117. The version in FIG. 2*b* is not described herein, to the same elements already described above corresponding to the same numeral references.

FIG. 9*c* illustrates a further version of the capsule 1 differing from the capsule in FIG. 9 in that it comprises an interaction member for interacting with the final product B contained in the second duct 517, to vary organoleptic or visual characteristics of such final product B before the delivering into the fruition container.

Such interaction member comprises a vortex flow generating member and/or a perforated member (not illustrated), the latter to perform a filtering function or, alternatively, to reduce or eliminate possible froth present in the final product B.

The vortex flow generating member comprises an elongated and rigid tubular-shaped insert 528 having a longitudinal side wall 529 provided with a helicoidal projection 530 extending longitudinally at least along a portion of said insert 528, in particular along the entire insert 528. The insert 528 is contained in the second duct 517 and creates an annular gap 531, between a smooth wall 532 of the second duct 517 and said side wall 529 provided with the projection 530. The annular gap 531 has channels with a helicoidal trend, to generate the vortex flow of fluid into the annular gap. In this manner, the final product B, before being delivered into the fruition container, is rotated and forced to flow with a vortex motion into the annular gap 531. The final product B is further mixed, thus the complete and homogeneous solubilization of products not much or slowly soluble is further promoted. The vortex motion may, in addition or alternatively, promote the formation of froth in the final product B, if desired. The insert 528 further comprises end projections 533 allowing holding the same insert 528 in place inside the second duct 517 by interference. Between a projection 533 and the other one, delivering passages of the final product B are defined.

The projection 530 illustrated in FIG. 9*b* has a longitudinal extent such as to be in the shape of a band, with coils tilted by 30° with respect to a longitudinal axis of the insert 528. The projection 530 may be also made in the shape of a thread (not shown). The pitch of the coils, the longitudinal extent of each coil, which dictates whether the projection is in the form of a band or a thread, and the thickness of the projection 530 in the perpendicular direction to the longitudinal axis of the insert 528 determine the rotation in the fluid and therefore they are selected based on the type of final product B to be obtained.

The perforated member may be for example obtained as an insert in the shape of a micro-perforated disc, or as a hollow tubular insert with opposite micro-perforated head walls, arranged in the second duct 517 and held in place by interference, to perform a filtering function and avoiding the exit of fragments of the initial product P into the fruition container that are possibly present in the final product B.

Alternatively, the perforated member may comprise an insert provided with a large mesh net to reduce or avoid a possible froth present in the final product B when the froth is not required for the particular final product B to be delivered.

The vortex flow generating member and the perforated member may be present alternatively in the second duct 517.

However, the vortex flow generating member and the perforated member may be present also at the same time in the second duct 517, if, for example, the final product B requires a further mixing to promote a complete solubilization of the initial product P, while the reduction of the possible froth created by the vortex flow before the delivering into the fruition container is desired.

Such interaction member is inserted in the second duct 517 in the production line, this reducing and simplifying a product storehouse.

The operation or use of this version of capsule 1 in an automatic brewing machine is substantially similar to that in FIG. 9 and to that of the versions illustrated in the remaining Figures, but, in addition, the final product B is further mixed and/or filtered and/or froth in it is created/avoided. Therefore, some qualitative characteristics of the final product B are changed in a simple and efficient manner, without the need for modifying the type of capsule to be produced.

Figure 2C:
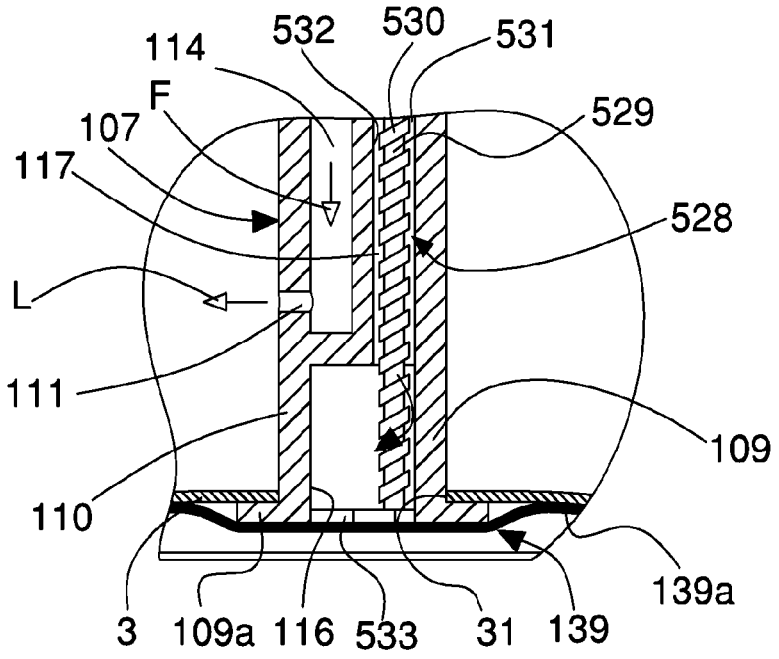
FIG. 2*c* is an enlarged detail of a different version of the capsule in FIG. 1, in which the second duct comprises an interaction member for interacting with a final product B.

The interaction member for interacting with the final product B, although described with particular reference to the FIG. 9*c*, could be provided inside the respective second ducts, also in the versions of the capsule 1 of the invention illustrated in the remaining figure. FIG. 2*c* shows, for example, a different version of the capsule 1, differing from the capsule in FIG. 1 in that it comprises an interaction member for interacting with the final product B contained in the second duct 117, and i.e. the capsule 1 comprises the tubular insert 528. The version in FIG. 2*c* is not described herein, to the same elements already described above corresponding the same numeral references.

Figure 10:
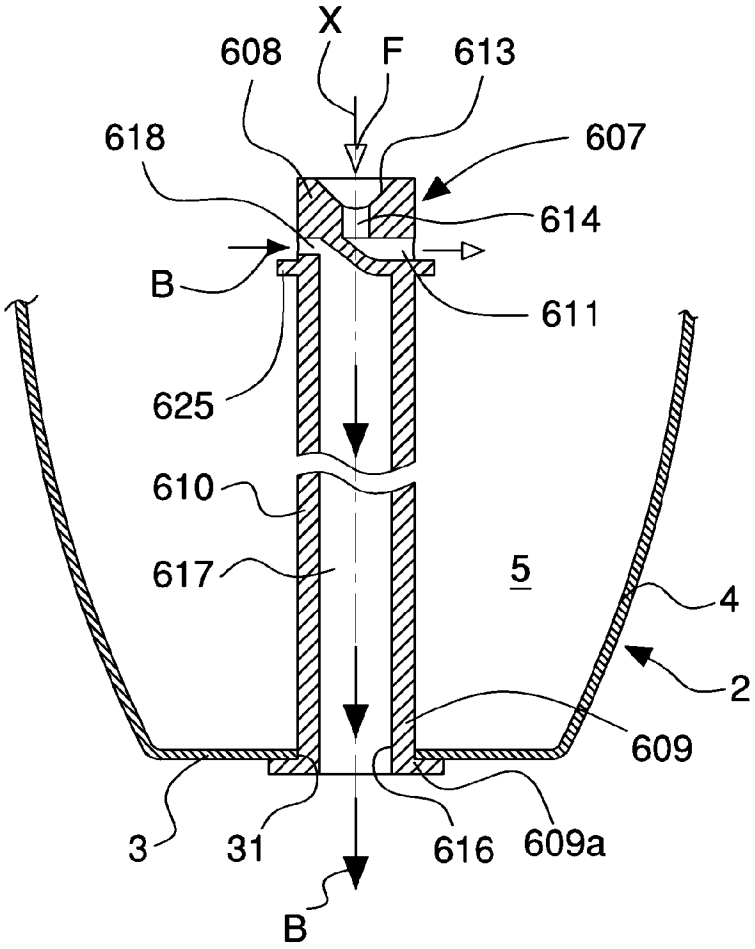

FIG. 10 illustrates a further version of the capsule 1 differing from the capsule in FIG. 8 since it comprises a respective nozzle 607, similar to the nozzle 407 described above, having a respective longitudinal side wall 610, a respective first end 608, and a respective second end 609 mutually opposite.

The nozzle 607 comprises a respective external flange 609*a*, similar to the external flange 109*a* in FIG. 3.

The nozzle 607 comprises a respective outflow opening 611 and a respective delivering opening 618 arranged substantially opposite to the first end 608, substantially aligned and orthogonal to the longitudinal side wall 610. The outflow opening 611 is flowingly connected with a respective first opening 613 with which the first end 608 is provided by a respective first duct 614, while the delivering opening 618 is flowingly connected with a respective second opening 616 with which the second end 609 is provided by a respective second duct 617. The first duct 614 and the second duct 617 are superimposed and substantially aligned to the longitudinal axis X of the nozzle 607. The nozzle 607 comprises a respective annular projection 625, similar to the annular projection 425 described with reference to FIG. 8.

The operation or use of this version of capsule 1 is substantially similar to that of the capsule in FIG. 8.

The tests performed showed that such version of capsule is in particular indicated for initial products comprising liquid concentrates.

In a non-illustrated version of the capsule 1 and with particular reference to the FIGS. 1 to 5, the external flange 109*a* of the nozzle 107 has an external surface which is provided with an annular groove with a triangular cross-section near to the second opening 116 which is suitable to direct the final product B when it exits the capsule 1 through the above-mentioned second opening 116. Such groove may aid in more accurately directing the final product B flow into the fruition container. Such annular groove may be implementable also in the external flange of the nozzles shown in the versions of the capsule 1 of the invention, illustrated in the remaining Figures.

In a further non-illustrated version of the capsule and with reference to the FIGS. 1 to 5, the base wall 3 may comprise an edge or annular wall extending about the exit opening 31 and inside or outside the cavity 5. The annular wall is intended to sealingly engage the longitudinal side wall 110 of the nozzle 107. The cross-sections of the nozzle 107 and annular wall are of a complementary shape.

Such version of the base wall 3 may be applied also to the versions of the capsule 1 of the invention illustrated in the remaining Figures.

It is further pointed out that all what has been stated regarding the closing element 139 shown in the FIGS. 11 and 12 and provided for insulating the cavity 5 against the external environment, described above with particular reference to the nozzle 107 of the capsule 1 of the FIGS. 1-5 may be applied also to the versions of the capsule 1 illustrated in the remaining figures.

Again, it has been stated above that the covering element 19 is fixed by welding to the nozzle 107 to create a fluid seal between the covering element 19 and the first end 108 of the nozzle 107.

Again, what has been described above with particular reference to the nozzle 107 of the capsule 1 of the FIGS. 1-5 may be applied also to the versions of the capsule 1 illustrated in the remaining Figures, with particular reference also to the nozzles 207, 307, 407, 507, and 607, each being fixed by welding to the covering element 19.

According to a further non-illustrated version, the initial product P is contained in a non-woven fabric bag, when the exit of fragments of the initial product P into the fruition container is note desired. The initial product P, for example a product for infusion, may be contained in a bag, for example, in the shape of a sachet, similar to those for tea consumption. However, the bag may also be of a different shape, and for example provided with a hole, for example in the shape of a doughnut, so as to house the nozzle in such hole and to ensure the positioning of the bag inside the capsule about the nozzle.

Whichever the shape of such bag, the capsule may contain multiple bags containing products of a different type and/or differently flavored, to obtain a two-flavored final product B, as an nut-flavored Americano coffee or a mint-flavored tea.

The invention claimed is:

1. Capsule, comprising:

a deformable and/or crushable casing provided with a base wall and a side wall defining a cavity suitable for containing an initial product to be joined to a fluid for making a final product, wherein said casing comprises an edge and said side wall comprises preset pliability lines along which said side wall is deformable and/or crushable;

a covering element fixed to said edge to hermetically close said cavity;

a nozzle comprising a longitudinal side wall and a first end fixed to said covering element and provided with a first opening suitable to engage an injecting arrangement of said fluid of a brewing machine, said longitudinal side wall being provided with at least one outflow opening connected to said first opening through a first duct for introducing said fluid in said cavity in an injecting step;

wherein said nozzle is arranged inside said cavity, comprises at least one delivering opening made along said longitudinal side wall and a second end that is opposite to said first end, comes out partially from said cavity through an exit opening of said base wall and is provided with a second opening connected to said delivering opening through a second duct, said delivering opening and said second duct said at least one delivering opening is inside said cavity before said casing is deformed and/or crushed enabling said final product to exit from said cavity through said second opening and be delivered directly into a fruition container in a delivering step.

2. Capsule according to claim 1, wherein said nozzle comprises a rigid and elongated tubular element.

3. Capsule according to claim 1, wherein said first duct and said second duct are positioned side by side and extend substantially over the entire length of said nozzle substantially parallel to a longitudinal axis of said nozzle.

4. Capsule according to claim 1, wherein said first duct and said second duct are superimposed and substantially aligned to a longitudinal axis of said nozzle.

5. Capsule according to claim 1, wherein said outflow opening is made in the proximity of said second end and said delivering opening is made in the proximity of said first end.

6. Capsule according to claim 1, wherein said outflow opening and said delivering opening are made in the proximity of said first end.

7. Capsule according to claim 1, comprising a plurality of outflow openings that are made spaced apart from each other along said longitudinal side wall and connected to said first opening through said first duct, and a plurality of delivering openings that are made spaced apart from each other along said longitudinal side wall and connected to said second opening through said second duct.

8. Capsule according to claim 1, wherein said side wall is compressible and/or crushable along a direction that is transverse, in particular orthogonal, to said base wall in order to enable said final product to exit from said cavity and said nozzle to further exit from said cavity.

9. Capsule according to claim 1, wherein said nozzle is inserted and sealingly slides with interference in said exit opening.

10. Capsule according to claim 1, wherein said nozzle comprises an annular projection that is positioned adjacent to said delivering opening and is arranged for avoiding a compression and/or a complete crushing of said casing and preventing a complete exit of said nozzle from said capsule.

11. Capsule according to claim 1, comprising a closing element removably fixed to a peripheral edge of said second end and/or to an external surface of said base wall so as to hermetically close at least said second opening and said cavity.

12. Capsule according to claim 11, and comprising a solid product contained in said second duct closed by said closing element and deliverable directly into said fruition container through said second opening before said delivering step.

13. Capsule according to claim 12, wherein said solid product is constituted of a single element having at least one dimension that is greater than, or the same as, a width of said delivering opening in such a manner that said delivering opening prevents said solid product from exiting said second duct towards said cavity.

14. Capsule according to claim 12, wherein said solid product is constituted of a plurality of elements each having at least one dimension that is greater than, or the same as, a width of said delivering opening in such a manner that said delivering opening prevents said solid product from exiting said second duct towards said cavity.

15. Capsule according to claim 14, wherein said elements are homogeneous elements comprising one of sweeteners or cereals, or wherein said elements are non-homogeneous elements comprising a mixture of sweeteners and cereals.

16. Capsule according to claim 11, wherein said closing element comprises a joining edge, said joining edge being fixed for a first part to said external surface of said base wall by a blocking seal and for a second part by a peelable seal, said blocking seal requiring greater force than said peelable seal to detach said joining seal from said base wall, so as to promote said detachment of said second part before said detachment of first part.

17. Capsule according to claim 16, wherein said first part extends in a first angular interval comprised between 80° and 110°, and said second part extends in a second angular interval that is explementary to said first angular interval, said first part and said second part extending over the entire joining edge.

18. Capsule according to claim 16, wherein said second part comprises a detachment promoting arrangement comprising at least one detachment portion at which said second portion has a substantially or wedge shape to facilitate a gradual and progressive separation of the joining edge from the base wall.

19. Capsule according to claim 18, wherein said first part is devoid of said detachment promoting arrangement.

20. Capsule according to claim 18, wherein said detachment promoting arrangement comprises a plurality of detachment portions that are angularly equidistant in said second part.

21. Capsule according to claim 1, and wherein said covering element is perforable by said injecting arrangement of the brewing machine for enabling said injecting arrangement to engage said first opening of said nozzle.

22. Capsule according to claim 21, wherein said covering element is fixed by welding to said first end of said nozzle for creating a fluid seal between said covering element and said first end.

23. Capsule according to claim 1, and comprising an interaction member for interacting with said final product which is contained in said second duct for changing characteristics of said final product before delivering into said fruition container.

24. Capsule according to claim 23, wherein said interaction member comprises an element for creating a vortex flow and/or a perforated element for making a filtering function or alternatively for reducing or eliminating possible froth present in the final product.

25. Capsule according to claim 24, wherein said element for creating a vortex flow comprises an elongated tubular shaped insert having a longitudinal side wall provided with a helicoidal projection extending longitudinally at least along a portion of said insert.

26. Capsule according to claim 25, wherein said capsule has an annular gap between a smooth wall of said second duct and said side wall of said insert provided with said projection, said annular gap having helicoidal channels for creating said vortex flow.

27. Capsule according to claim 26, wherein said closing element comprises an elongated tab extending outwards from a connecting portion of the joining edge that extends from said first part.

28. Capsule according to claim 1, wherein said second end of said nozzle has an external flange which peripherally surrounds said second opening and which in an initial configuration of said capsule, abuts against an external surface of said base wall.

* * * * *